US006065618A

United States Patent [19]

Stetler

[11] Patent Number: 6,065,618

[45] Date of Patent: May 23, 2000

[54] CLOSET ORGANIZING SYSTEM

[76] Inventor: Allen Stetler, 9 Edge Hill Rd., Boyertown, Pa. 19512

[21] Appl. No.: 08/974,052

[22] Filed: Nov. 19, 1997

[51] Int. Cl.[7] ..... A47H 1/00

[52] U.S. Cl. ..... 211/96; 248/125.8; 211/168; 211/205

[58] Field of Search ..... 211/86.01, 87.01, 211/168, 96, 104, 205, 196; 248/125.8, 125.7, 218.4, 282.1, 200.1, 125.3, 157, 422

[56] References Cited

U.S. PATENT DOCUMENTS

| | | | |
|---|---|---|---|
| 163,353 | 5/1875 | Bent | 211/168 |
| D. 261,704 | 11/1981 | Parker | D6/28 |
| 896,990 | 8/1908 | Hill | 248/125.3 |
| 1,032,788 | 7/1912 | Slacinski | 160/348 |
| 1,278,790 | 9/1918 | Thunell | 312/324 |
| 1,913,215 | 6/1933 | Schwartz et al. | 211/85.3 |
| 2,505,671 | 4/1950 | Hermes | 211/96 |
| 2,506,193 | 5/1950 | Bedford et al. | 211/96 |
| 2,903,227 | 8/1959 | Kalb Key | 248/200.1 |
| 2,941,669 | 6/1960 | Palay et al. | 211/1.55 |
| 3,035,708 | 5/1962 | Freeman | 211/107 |
| 3,310,180 | 3/1967 | Neagle | 211/205 |
| 4,104,972 | 8/1978 | Baublitz | 108/131 |
| 4,463,883 | 8/1984 | DeVore | 224/42.44 |
| 4,725,027 | 2/1988 | Bekanich | 248/125 |
| 5,022,722 | 6/1991 | Wallin | 312/309 |
| 5,078,276 | 1/1992 | Rogge et al. | 211/18 |
| 5,127,528 | 7/1992 | Cone | 211/34 |
| 5,143,231 | 9/1992 | Chang | 211/96 |
| 5,318,175 | 6/1994 | Stevens | 211/86 |
| 5,318,189 | 6/1994 | Lee | 211/205 |
| 5,405,065 | 4/1995 | Olson | 223/9 D |
| 5,833,081 | 11/1998 | Smith | 211/86.01 |
| 5,862,924 | 1/1999 | Dumont | 211/85.7 |

*Primary Examiner*—Ramon O. Ramirez
*Assistant Examiner*—Tan Le

[57] ABSTRACT

A new closet organizing system for providing greater organization and storage space in a closet. The inventive device includes a telescoping pole rotatably disposed between a ceiling and a floor of a closet. A pair of support arms are secured to the telescoping pole. The pair of support arms each have a hollow support portion and an angular support bracket. The hollow support arm has a rotating gear system disposed therein. The gear system includes a plurality of individual gears. A plurality of hanger loops extend downwardly through the hollow support portion of the support arms and engage the plurality of individual gears of the rotating gear system.

6 Claims, 3 Drawing Sheets

CLOSET ORGANIZING SYSTEM

BACKGROUND OF THE INVENTION

1. Field of the Invention

The present invention relates to clothes supports and more particularly pertains to a new closet organizing system for providing greater organization and storage space in a closet.

2. Description of the Prior Art

The use of clothes supports is known in the prior art. More specifically, clothes supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art clothes supports include U.S. Pat. No. 5,022,722 to Wallin; U.S. Pat. No. 4,104,972 to Baublitz; U.S. Pat. No. Des. 261,704 to Parker; U.S. Pat. No. 5,405,065 to Olson; U.S. Pat. No. 4,463,883 to DeVore; and U.S. Pat. No. 5,318,175 to Stevens.

While these devices fulfill their respective, particular objectives and requirements, the aforementioned patents do not disclose a new closet organizing system. The inventive device includes a telescoping pole rotatably disposed between a ceiling and a floor of a closet. A pair of support arms are secured to the telescoping pole. The pair of support arms each have a hollow support portion and an angular support bracket. The hollow support arm has a rotating gear system disposed therein. The gear system includes a plurality of individual gears. A plurality of hanger loops extend downwardly through the hollow support portion of the support arms and engage the plurality of individual gears of the rotating gear system.

In these respects, the closet organizing system according to the present invention substantially departs from the conventional concepts and designs of the prior art, and in so doing provides an apparatus primarily developed for the purpose of providing greater organization and storage space in a closet.

SUMMARY OF THE INVENTION

In view of the foregoing disadvantages inherent in the known types of clothes supports now present in the prior art, the present invention provides a new closet organizing system construction wherein the same can be utilized for providing greater organization and storage space in a closet.

The general purpose of the present invention, which will be described subsequently in greater detail, is to provide a new closet organizing system apparatus and method which has many of the advantages of the clothes supports mentioned heretofore and many novel features that result in a new closet organizing system which is not anticipated, rendered obvious, suggested, or even implied by any of the prior art clothes supports, either alone or in any combination thereof.

To attain this, the present invention generally comprises a telescoping pole including an upper section and a lower section. The telescoping pole is rotatably disposed between a ceiling and a floor of a closet. A ceiling bracket engages an upper end of the upper section of the telescoping pole. The ceiling bracket has a central member with upwardly extending edge portions. The edge portions has outwardly extending tab portions. The tab portions arc secured to the ceiling of the closet. The central member has a plurality of holes therethrough for selectively coupling with the upper end of the upper section of the telescoping pole. A floor bracket engages a lower end of the lower section of the telescoping pole. The floor bracket comprises a central disk secured to the floor of the closet. The central disk has a recess formed in a central portion thereof for receiving the lower end of the lower section of the telescoping pole. A pair of support arms are secured to the telescoping pole. The pair of support arms include an upper arm secured to the upper section of the telescoping pole and a lower arm secured to the lower section of the telescoping arm. The pair of support arms each have a hollow support portion and an angular support bracket. The hollow support arm has a rotating gear system disposed therein. The gear system includes a plurality of individual gears. A plurality of hanger loops extend downwardly through the hollow support portion of the support arms and engage the plurality of individual gears of the rotating gear system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new closet organizing system apparatus and method which has many of the advantages of the clothes supports mentioned heretofore and many novel features that result in a new closet organizing system which is not anticipated, rendered obvious, suggested, or even implied by any of the prior art clothes supports, either alone or in any combination thereof.

It is another object of the present invention to provide a new closet organizing system which may be easily and efficiently manufactured and marketed.

It is a further object of the present invention to provide a new closet organizing system which is of a durable and reliable construction.

An even further object of the present invention is to provide a new closet organizing system which is susceptible of a low cost of manufacture with regard to both materials and labor, and which accordingly is then susceptible of low prices of sale to the consuming public, thereby making such closet organizing system economically available to the buying public.

Still yet another object of the present invention is to provide a new closet organizing system which provides in the apparatuses and methods of the prior art some of the advantages thereof, while simultaneously overcoming some of the disadvantages normally associated therewith.

Still another object of the present invention is to provide a new closet organizing system for providing greater organization and storage space in a closet.

Yet another object of the present invention is to provide a new closet organizing system which includes a telescoping pole rotatably disposed between a ceiling and a floor of a closet. A pair of support arms are secured to the telescoping pole. The pair of support arms each have a hollow support portion and an angular support bracket. The hollow support arm has a rotating gear system disposed therein. The gear system includes a plurality of individual gears. A plurality of hanger loops extend downwardly through the hollow support portion of the support arms and engage the plurality of individual gears of the rotating gear system.

Still yet another object of the present invention is to provide a new closet organizing system that allows clothes to be hung in a neat, orderly fashion.

Even still another object of the present invention is to provide a new closet organizing system that expand the space in any closet for hanging clothes and storing items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there arc illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
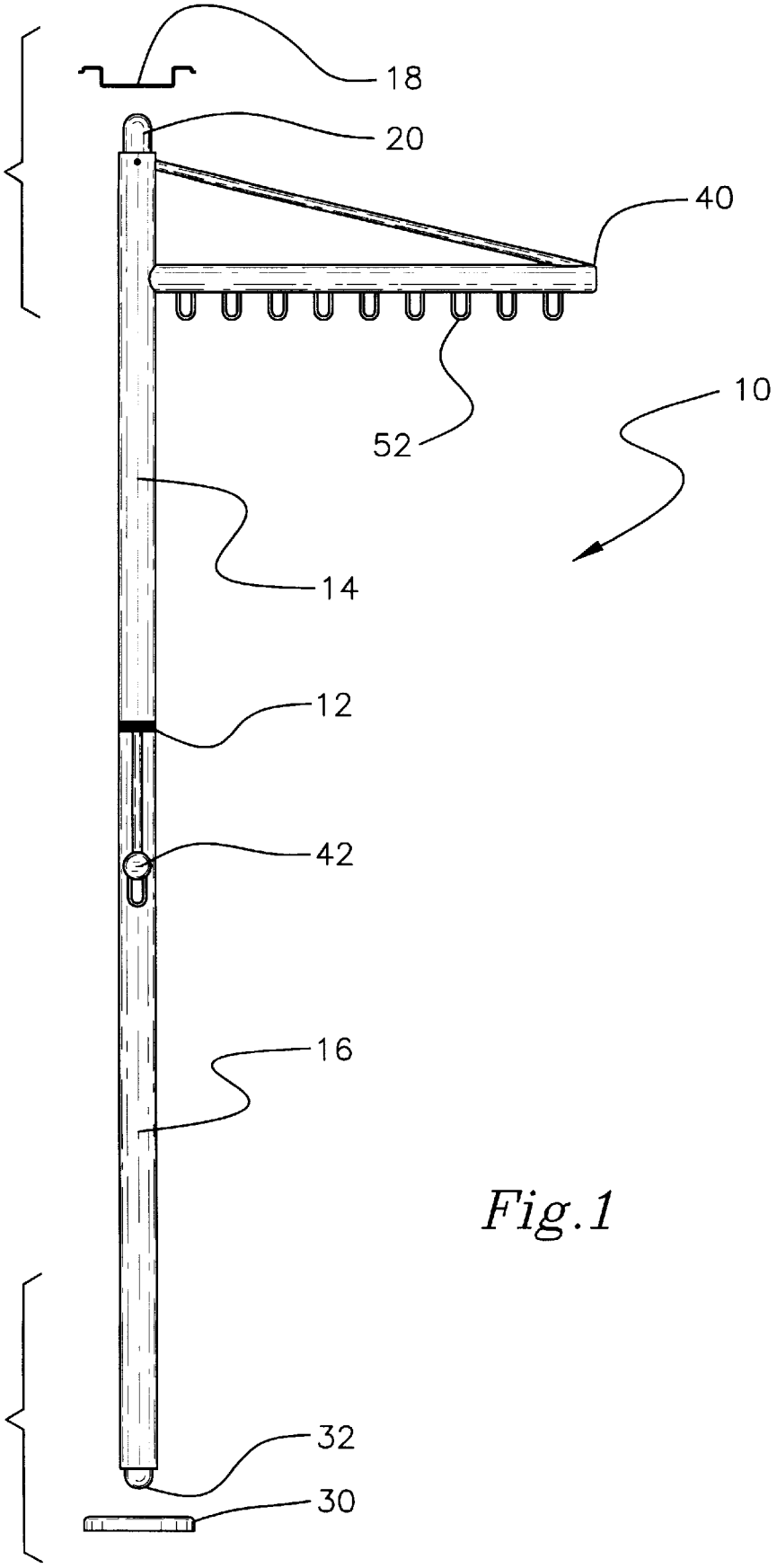
FIG. 1 is a side view of a new closet organizing system according to the present invention.
Figure 2:
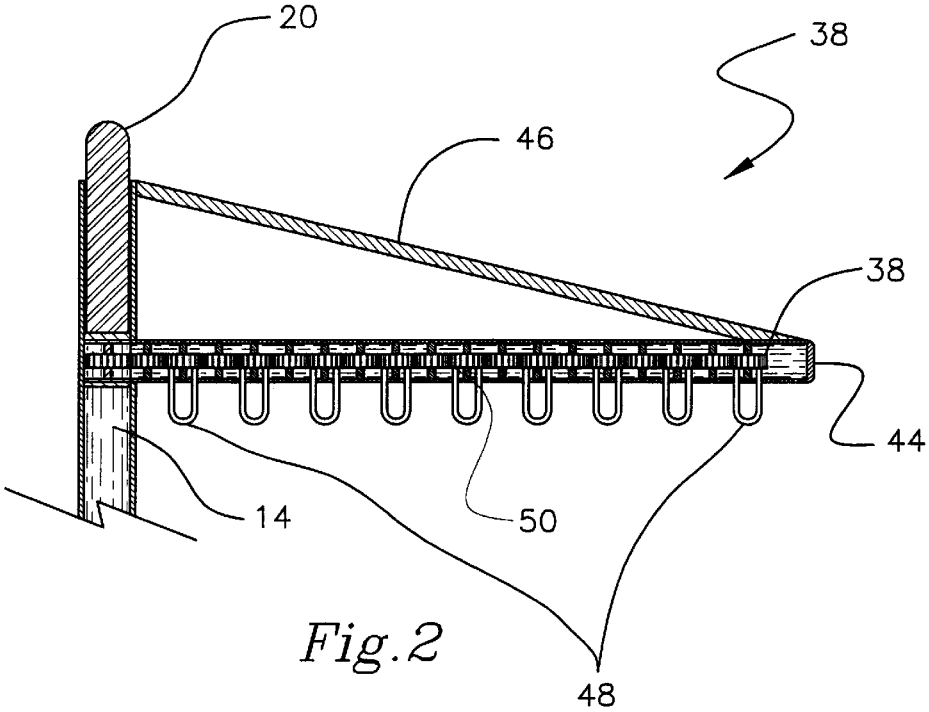
FIG. 2 is a sectional top view of the present invention.
Figure 3:
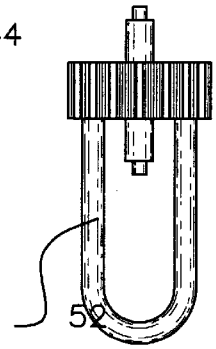
FIG. 3 is a front view of a hanger loop of the present invention.
Figure 4:
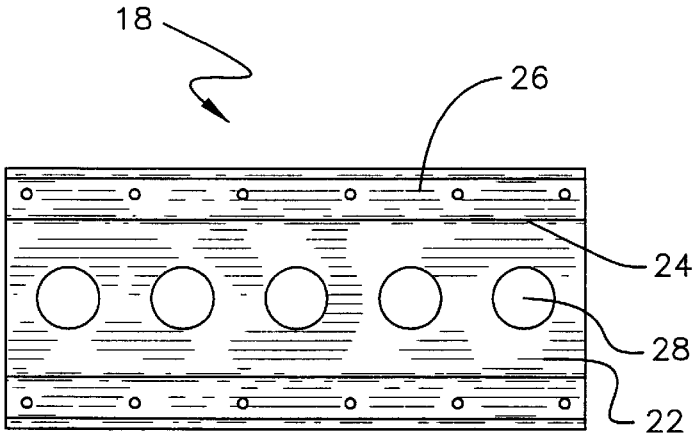
FIG. 4 is a plan view of the ceiling bracket of the present invention.
Figure 5:
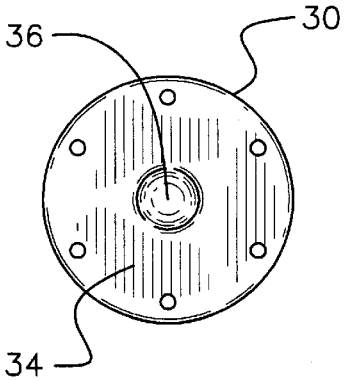
FIG. 5 is a plan view of the floor bracket of the present invention.
Figure 6:
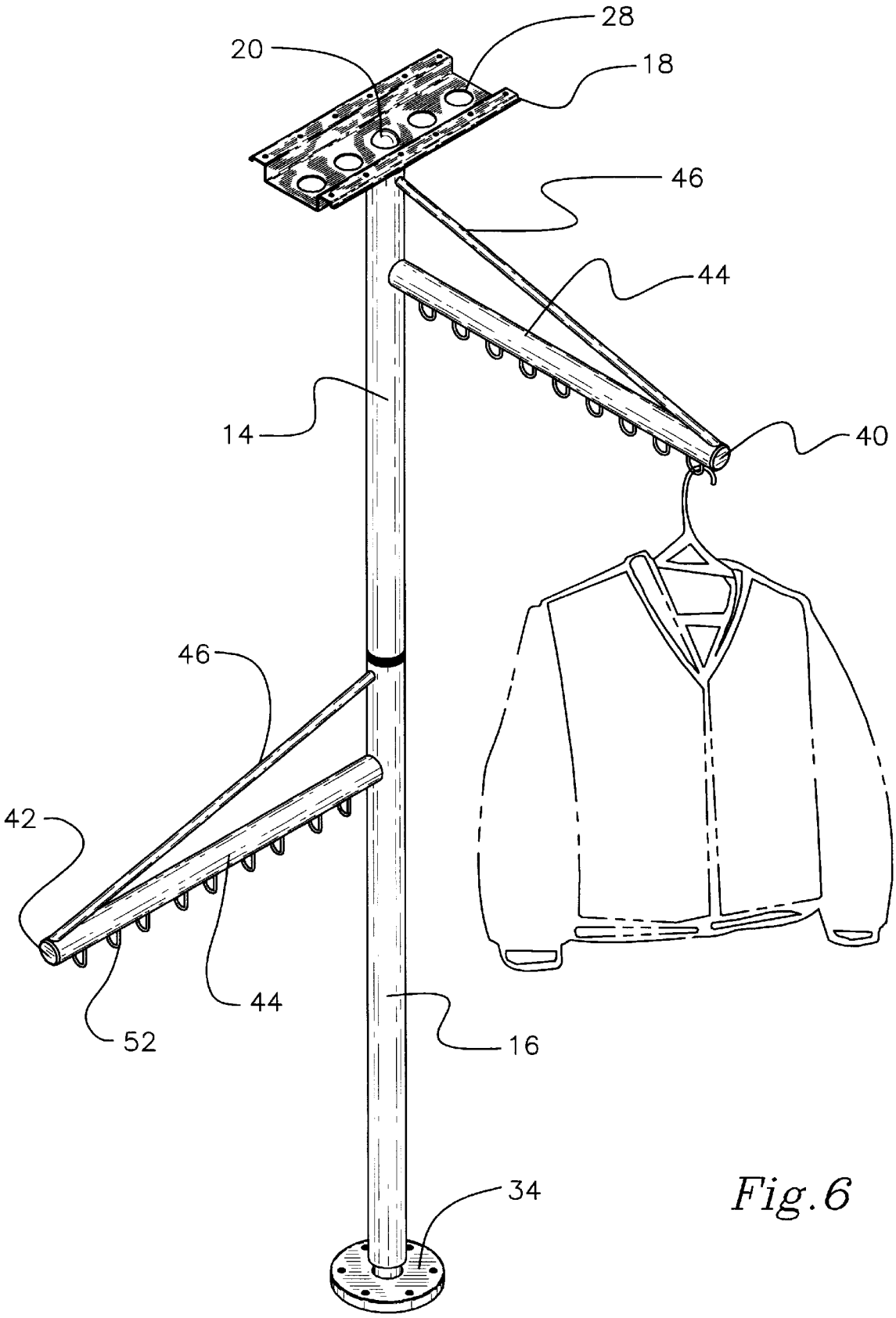
FIG. 6 is a perspective view of the invention.

With reference now to the drawings, and in particular to FIGS. 1 through 6 thereof, a new closet organizing system embodying the principles and concepts of the present invention and generally designated by the reference numeral 10 will be described.

As best illustrated in FIGS. 1 through 6, the closet organizing system 10 comprises a telescoping pole 12 including an upper section 14 and a lower section 16. The telescoping pole 12 is rotatably disposed between a ceiling and a floor of a closet.

A ceiling bracket 18 engages an upper end 20 of the upper section 14 of the telescoping pole 12. The ceiling bracket 18 has a central member 22 with upwardly extending edge portions 24. The edge portions 24 has outwardly extending tab portions 26. The tab portions 26 are secured to the ceiling of the closet. The central member 22 has a plurality of holes 28 therethrough for selectively coupling with the upper end 20 of the upper section 14 of the telescoping pole 12.

A floor bracket 30 engages a lower end 32 of the lower section 16 of the telescoping pole 12. The floor bracket comprises a central disk 34 secured to the floor of the closet. The central disk 34 has a recess 36 formed in a central portion thereof for receiving the lower end 32 of the lower section 16 of the telescoping pole 12.

A pair of support arms 38 are secured to the telescoping pole 12. The pair of support arms 38 include an upper arm 40 secured to the upper section 14 of the telescoping pole 12 and a lower arm 42 secured to the lower section 16 of the telescoping arm 12. The pair of support arms 38 each have a hollow support portion 44 and an angular support bracket 46. The hollow support arm 44 has a rotating gear system 48 disposed therein. The gear system 48 includes a plurality of individual gears 50.

A plurality of hanger loops 52 extend downwardly through the hollow support portion 44 of the support arms 38 and engage the plurality of individual gears 50 of the rotating gear system 48.

In use, the telescoping pole 12 is secured within the closet via the ceiling bracket 18 and the floor bracket 30. The plurality of holes 28 in the ceiling bracket 18 allow for the user to select the positioning of the telescoping pole 12. The upper and lower ends 20,32 of the telescoping pole 12 will be nylon or coated with Teflon® for ease in pivoting. The two support arms 38 are secured to the telescoping pole 12, one on the upper section 14 and one on the lower section 16. The two support arms 38 would move independently of the other. The gears 50 inside the hollow arms 44 would aid in rotating the hanger loops 52 from which clothing would hang. With a closet door closed, the system 10 would be pushed into compact storage and in this position the clothing would hang parallel to the support arm 38 from which it is suspended. To make a clothing selection, the user would simply open the closet door and pull the support arms 38 around by grasping the first garment or hanger. The user simply turns the clothing by the support arm 38 by pulling that hanger or garment until the clothing hangs perpendicular to the support arm 38. All the clothing on the support arm 38 will turn since all are connected through the series of gears 50.

In an alternate embodiment the user would simply pull the support arm 38 forward and the clothing would turn automatically. The use of a stationary rod attached to the floor inside of the plate 30. The rod would include gear teeth that would mesh with the gears 50 to all of the gears to rotate thus turning clothing hanging therefrom. The upper pole 14 would house a similar rod, but the attachment to the lower rod would be through a coupling on top of the lower rod.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new closet organizing system for providing greater organization and storage space in a closet comprising, in combination:

a telescoping pole including an upper section and a lower section, the telescoping pole rotatably disposed between a ceiling and a floor of a closet;

a ceiling bracket engaging an upper end of the upper section of the telescoping pole, the ceiling bracket having a central member with upwardly extending edge portions, the edge portions having outwardly extending tab portions, the tab portions secured to the ceiling of the closet, the central member having a plurality of holes therethrough for selectively coupling with the upper end of the upper section of the telescoping pole;

a floor bracket engaging a lower end of the lower section of the telescoping pole, the floor bracket comprising a central disk secured to the floor of the closet, the central disk having a recess formed in a central portion thereof for receiving the lower end of the lower section of the telescoping pole;

a pair of support arms secured to the telescoping pole, the pair of support arms including an upper arm secured to the upper section of the telescoping pole and a lower arm secured to the lower section of the telescoping arm, the pair of support arms each having a hollow support portion and an angular support bracket, the hollow support arm having a rotating gear system disposed therein, the gear system including a plurality of individual gears; and a plurality of hanger loops extending downwardly through the hollow support portion of the support arms and engaging the plurality of individual gears of the rotating gear system.

2. A new closet organizing system for providing greater organization and storage space in a closet comprising, in combination:

a telescoping pole rotatably disposed between a ceiling and a floor of a closet;

a pair of support arms secured to the telescoping pole, the pair of support arms each having a hollow support portion and an angular support bracket, the hollow support arm having a rotating gear system disposed therein, the gear system including a plurality of individual gears; and a plurality of hanger loops extending downwardly through the hollow support portion of the support arms and engaging the plurality of individual gears of the rotating gear system.

3. The closet organizing system as set forth in claim 2 and further including a ceiling bracket engaging an upper end of the telescoping pole, the ceiling bracket having a central member with upwardly extending edge portions, the edge portions having outwardly extending tab portions, the tab portions for securing to the ceiling of the closet.

4. The closet organizing system as set forth in claim 3 wherein the central member has a plurality of holes therethrough for selectively coupling with the upper end of the upper section of the telescoping pole.

5. The closet organizing system as set forth in claim 2 and further including a floor bracket engaging a lower end of the lower section of the telescoping pole, the floor bracket comprising a central disk for securing to the floor of the closet, the central disk having a recess formed in a central portion thereof for receiving the lower end of the lower section of the telescoping pole.

6. A new closet organizing system for providing greater organization and storage space in a closet comprising:

a telescoping pole rotatably disposed between a ceiling and a floor of a closet;

a pair of support arms secured to the telescoping pole, the pair of support arms each having a support portion and an angular support bracket, the support arm having a rotating gear system disposed therein, the gear system including a plurality of individual gears; and a plurality of hanger loops extending upwardly through the support portion of the support arms and engaging the plurality of individual gears of the rotating gear system.

* * * * *